United States Patent [19]

Borst et al.

[11] Patent Number: 5,012,953

[45] Date of Patent: May 7, 1991

[54] METHOD OF OPERATING A HOT MELT DISPENSER

[75] Inventors: Willi Borst, Florstadt; Christian Wooge, Bad Homburg, both of Fed. Rep. of Germany

[73] Assignee: Bostik, Inc., Middletown, Mass.

[21] Appl. No.: 420,606

[22] Filed: Nov. 21, 1989

Related U.S. Application Data

[63] Continuation of Ser. No. 238,805, Aug. 31, 1988, abandoned.

[30] Foreign Application Priority Data

Oct. 6, 1987 [GB] United Kingdom ..... 8723427

[51] Int. Cl.[5] ..... B67D 5/42

[52] U.S. Cl. ..... 222/1; 222/146.2; 222/415

[58] Field of Search ..... 222/146.2, 146.5, 414, 222/415; 198/626.5; 221/218, 253, 259

[56] References Cited

U.S. PATENT DOCUMENTS

| | | | |
|---|---|---|---|
| 1,109,144 | 9/1914 | Perkins . | |
| 1,449,517 | 3/1923 | Lame . | |
| 1,898,014 | 2/1933 | Krumholz . | |
| 2,690,591 | 10/1954 | Wallace . | |
| 2,915,171 | 12/1959 | Peck . | |
| 2,979,237 | 4/1961 | Snow et al. . | |
| 3,261,390 | 7/1966 | Saito et al. . | |
| 3,604,597 | 9/1971 | Pohl et al. . | |
| 3,685,690 | 8/1972 | Karecki et al. | 221/218 |
| 4,032,046 | 6/1977 | Elliott et al. . | |
| 4,039,109 | 8/1977 | Rhodes . | |
| 4,059,204 | 11/1977 | Duncan et al. . | |
| 4,230,218 | 10/1980 | Kunzmann | 198/627 |
| 4,585,432 | 4/1986 | Marysse | 198/627 |
| 4,588,109 | 5/1986 | Cameron et al. . | |
| 4,613,062 | 9/1986 | Walter et al. . | |
| 4,639,155 | 1/1987 | Schuster . | |
| 4,677,852 | 5/1987 | Siemann . | |
| 4,698,993 | 10/1987 | Fulier . | |
| 4,938,388 | 7/1990 | Yeh | 222/146.5 |
| 4,953,755 | 9/1990 | Dennison | 222/146.5 |

FOREIGN PATENT DOCUMENTS

| | | |
|---|---|---|
| 3341201 | 5/1985 | Fed. Rep. of Germany . |
| 2369011 | 5/1978 | France . |
| 904945 | 9/1962 | United Kingdom . |

*Primary Examiner*—Robert P. Olszewski
*Assistant Examiner*—Steve Reiss
*Attorney, Agent, or Firm*—David G. Conlin; Peter F. Corless; Gregory D. Williams

[57] ABSTRACT

Trigger-operated hot-melt dispenser with positive-feed mechanism wherein at least one continuous feed-belt in axial contact with a rod of thermoplastic material and operated to urge said rod into the melt chamber of said hot-melt dispenser is characterized in that release of the trigger first reverses the feed-belt to withdraw the rod a pre-set amount away from the melt-chamber and after a pre-set interval moves the feed-belt transversely out of contact with the rod. This facilitates removal and replacement of a part-spent rod. Preferably the rate of the transverse movement is greater than the tracking speed of the belt. A preferred embodiment includes twin, parallel feed belts which together grip an intervening rod.

1 Claim, 3 Drawing Sheets

METHOD OF OPERATING A HOT MELT DISPENSER

This is a continuation of now abandoned application Ser. No. 238,805 filed on Aug. 31, 1988.

TECHNICAL FIELD

This invention relates to a feed for hot-melt dispensers, particularly of the kind known as hot-melt guns.

Various proposals have been made to provide apparatus for melting and dispensing thermoplastic material, often supplied in the form of a rod. Such applicators are usually provided with a melt body having a melt chamber in which thermoplastic material may be melted, an inlet to the melt chamber and an outlet comprising an orifice for dispensing and applying melted material, means for feeding solid thermoplastic material through the inlet into the melt chamber and means for heating the melt body so that thermoplastic material is melted in the melt chamber before it is expelled through the outlet and can thus be dispensed and applied in molten condition from the orifice. Such applicators find use in various fields of application, commonly in the form of applicators for hot-melt adhesives and sealants and especially in hot-melt glue-guns having provision for feeding adhesive, often in the form of a rod known as a glue stick, to the melt body, for example by trigger-operated means.

BACKGROUND ART

The present invention is concerned with hot-melt dispensers for melting rods of thermoplastic material and dispensing and applying the resulting hot-melt materials, and more particularly is concerned with hand-held glue-guns.

In our European patent specification 0 257 838 (U.S. Ser. No. 249,237) is described and claimed, a hot-melt gun provided with trigger-operated feeding means for feeding a solid rod of thermoplastic material to the melt-chamber of said hot-melt gun is characterised by a positive feed mechanism comprising at least one driven elongated feed member controlled by drive means operated by the trigger, said elongated feed member comprising a driven continuous feed-belt arranged with its longitudinal axis parallel to the axis of the rod of thermoplastic material being fed to the melt-chamber. The feed-belt may be arranged so that one outer face contacts the rod along a substantial part of its length. Preferably a second belt is arranged in parallel to contact the opposite side of the rod so that the rod is engaged between the two parallel belts. The second belt may also be driven either by the same motor that drives the feed-belt or by a separate motor or it may function as an idler.

The driven belts may be powered by any suitable means e.g. by hydraulic, pneumatic or clockwork devices but are preferably electrically driven by electric motors which can be arranged to drive one or more belts. The trigger may control the operation of the motor by conventional switching arrangements and these may incorporate control elements such as electronic computer chip devices. Such devices facilitate control of feed rate, can enable pre-set amounts to be extruded and also provide safeguards against overload pressures, over-heating, operation at below optimum temperature and similar undesirable conditions.

Throughout these specifications, the term "belt" is used to include all similar, continuous structures such as chains which are equally effective. For example, a so-called gripper chain lends itself very well to the incorporation of outfacing stud elements to form a hook-belt.

It is an object of the present invention to improve the design and operation of a glue-gun provided with belt-feed according to European patent specification

DISCLOSURE OF THE INVENTION

According to the present invention, a hot-melt dispenser comprising a positive feed mechanism including at least one feed belt is controlled so that operation of the trigger causes at least one feed-belt to contact an intervening rod of thermoplastic material to urge it towards the melt-chamber of the dispenser and release of the trigger first reverses the feed-belt to withdraw the rod a pre-set amount away from the melt chamber and after a pre-set interval moves at least one feed-belt in a direction substantially transverse to its longitudinal axis out of contact with said rod. This permits easy removal and replacement of the rod of thermoplastic material and is especially useful to enable a part-used rod to be changed. Subsequent operation of the trigger not only operates the belt drive but causes the feed-belt to move in the reverse transverse direction until it is again in contact with the rod which is again urged towards the melt-chamber.

Preferably the rate of transverse movement of the feed-belt is greater than the tracking speed at which the feed-belt operates.

Further according to the invention, a hot-melt dispenser provided with trigger-operated feeding means for feeding a solid rod of thermoplastic material to the melt chamber of said dispenser comprising a positive feed mechanism including a driven continuous feed-belt arranged with its longitudinal axis parallel to the axis of said rod is characterised in that the feed-belt is mounted on a platform arranged for transverse movement away from and towards the longitudinal axis, said transverse movement of the platform being arranged and adapted to be operated by the trigger through a delay device.

Preferably the positive feed mechanism of a dispenser according to the invention comprises a pair of parallel driven belts, each mounted on a platform arranged for transverse movement away from and towards the longitudinal axis of the belts.

BRIEF DESCRIPTION OF DRAWINGS

In order that the invention be better understood, a preferred embodiment of the invention will now be described in further detail with reference to the accompanying drawings in which.

DETAILED DESCRIPTION OF INVENTION

Figure 1:
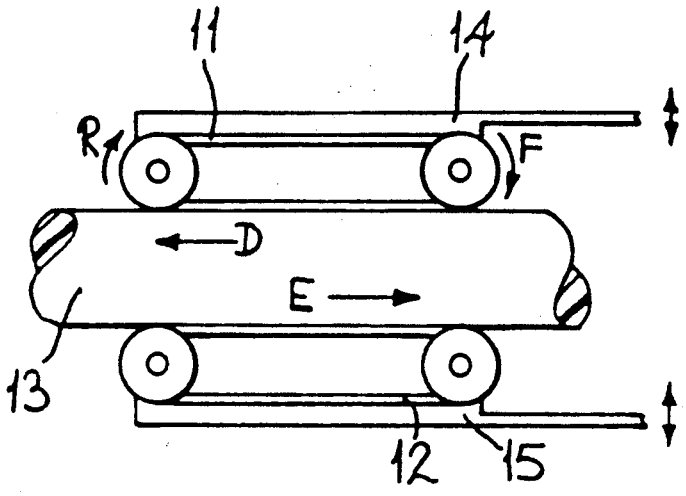
FIGS. 1 and 2 are schematic representations of the feeding means for a hot-melt gun, FIG. 1 showing the feeding means in its active position and FIG. 2 showing the feeding means in its passive position.
Figure 2:
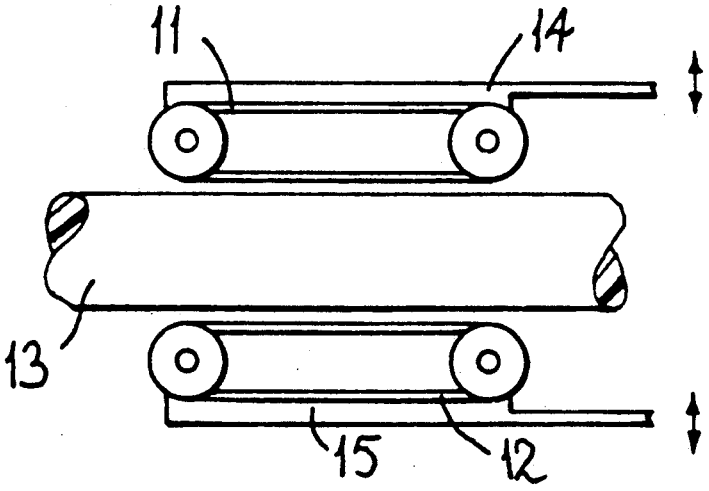

FIGS. 1 and 2 illustrate a twin-belt feed for a glue gun wherein feed-belts 11,12 are arranged with their respective longitudinal axes parallel to the axis of rod 13 which is a "glue-stick" comprising thermoplastic adhesive material. The outer surfaces of the feed-belts 11,12 have a corrugated finish and are arranged to contact rod 13 along a length of the rod so that it is gripped between feed belts 11 and 12 and when the feed-belts move as shown by F, the rod is urged in direction D. If the belt drive is reversed as shown by R, then the rod is urged in direction E.

The feed-belts 11,12 are carried respectively on platforms 14,15 and platforms 14,15 are capable of movement in a direction normal to the axis of the feed belts 11,12 and rod 13. The arrangement of the platform 14,15 is such that they can move between an active position, shown in FIG. 1, where the feed-belts 11,12 are in contact with rod 13 and a passive position, shown in FIG. 2, where the feed-belts 11,12 are spaced from rod 13.

Figure 4:
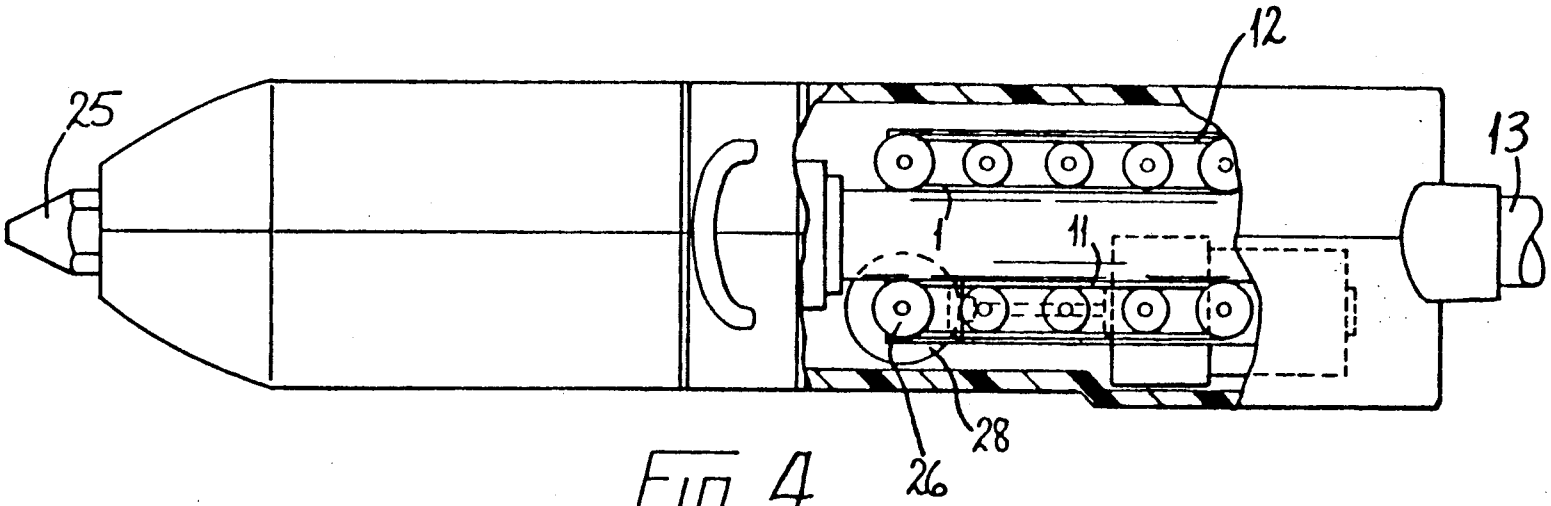
FIG. 4 is a plan view, part broken away, of the glue-gun of FIG. 3.
Figure 3:
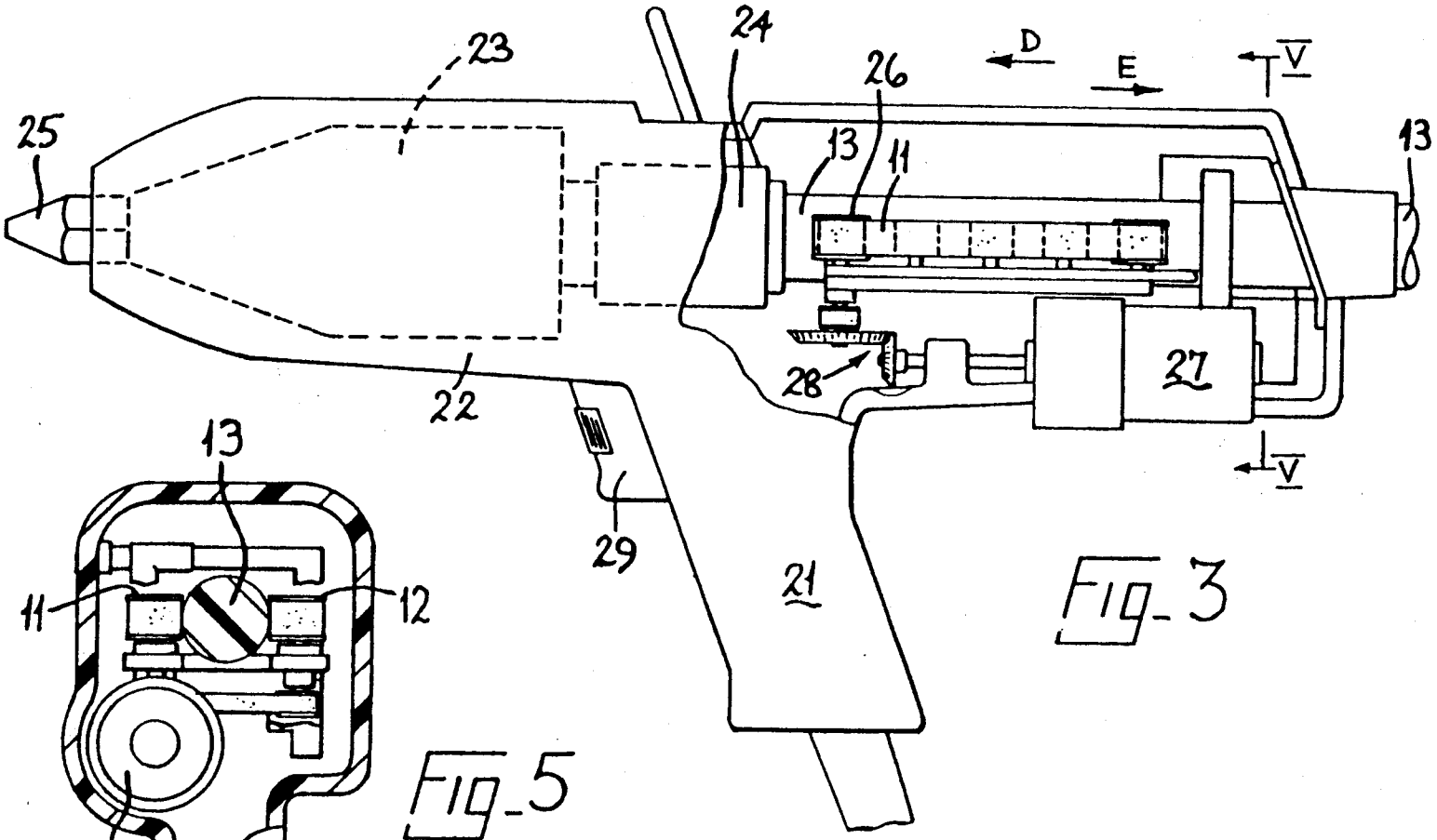
FIG. 3 is a side view of a glue-gun according to the invention, part in section, part broken away.
Figure 5:
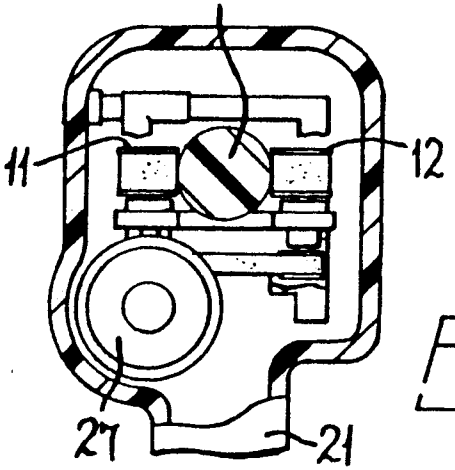
FIG. 5 is a cross-section on line V—V of FIG. 3.

The glue-gun illustrated in FIGS. 3, 4 and 5 is, in most respects, a conventional, hand-held glue-gun wherein a handle 21 supports a body 22 containing a melt chamber 23 into which thermoplastic glue material is fed in solid (stick) form through sleeve portions 24. The glue material is melted in melt-chamber 23 by heaters (not shown) mounted in the wall of melt chamber 23 and the resulting molten material is expelled from nozzle 25 by pressure applied to melt-chamber 23 by the feed of solid glue material through sleeve portion 24.

The illustrated glue-gun is fitted with feeding means according to the present invention by means of which a glue-stick 12 is fed through sleeve portion 24 to melt chamber 23. The feeding means comprises a pair of endless belts 11,12 which are located with their longitudinal axes parallel to the axis of glue-stick 12 with their outer, corrugated faces (having transverse ridges) in contact with opposite sides of glue-stick 12. Feed-belts 11,12 are driven by an electric motor 27 through gearing 28. Motor 27 is controlled by trigger 29 through electronic control devices (not shown) which respond not only to trigger 29 but also to the temperature of the molten material in melt-chamber 23, the pressure in melt chamber, the quantity of material fed into melt-chamber 23 through sleeve portion 24, the amount of molten material extruded through nozzle 25 etc.

In operation, glue-stick 13 is gripped between parallel faces of belts 11,12 and thereby constrained to move in the direction D of driven belt 11.

When trigger 29 is released, the direction of drive of feed belts is immediately reversed for a pre-set period sufficient to remove the pressure applied to the molten material in melt chamber 23 by the feeding of solid glue material (glue stick 13) into melt chamber 23.

If the trigger is operated within a pre-set period (a 20 second delay is normally used), the above operation cycle is repeated, that is to say, solid glue-stick is fed to the melt chamber 23 and molten material expelled from nozzle 25 whenever the trigger 29 is operated and the feed belts 11,12 are reversed to cut off the flow of molten material through nozzle 25 whenever the trigger is released. If, however, the trigger is NOT operated within the pre-set delay period, then the control devices activate the platforms 14,15 and moves said platform 14,15 outwards and thus move feed-belts 11,12 out of contact with rod 13.

The retracted rod 13 may then readily be removed and replaced by another rod without the need to melt the unused portion of rod 13.

Subsequent operation of the trigger causes the platforms 14,15 to move inwards so that feed-belts 11,12 are again in contact with rod 13 and continue to feed rod 13 into melt-chamber 23 whenever trigger 29 is operated, as described above.

The mechanism (not shown) which moves platforms 14,15 to move towards and away from rod 13 is arranged so that the rate of movement is faster than the rate at which the feed-belts 11,12 feed rod 13 into melt-chamber 23.

We claim:

1. A method for operating a hot melt dispenser having a trigger for operating the dispenser, a solid rod of thermoplastic material, a melt chamber for receiving the rod and a positive feed mechanism for feeding the rod into the melt chamber including opposed feed belts which are located with their longitudinal axes parallel to the axis of the solid rod comprising:

pulling the trigger to run the opposed feed belts in a feed rod direction and in the event at least one of the feed belts is spaced from the solid rod and located at a spaced position, displace the at least one feed belt spaced from the solid rod from the spaced position to position in engagement with the solid rod, releasing the trigger to run the opposed feed belts in an opposite retract direction for a predetermined period of time, and controlling the displacement of the at least one feed belt by pulling the trigger within a selected period of time to maintain said at least one feed belt in engagement with the rod and not pulling the trigger within said selected period of time to displace said at least one feed belt to the spaced position.

* * * * *